US008220963B2

(12) United States Patent
Huang et al.

(10) Patent No.: US 8,220,963 B2
(45) Date of Patent: Jul. 17, 2012

(54) LIGHT MODULE WITH A DISTINGUISHABLE CHARACTERISTIC AND A DETACHABLE FEATURE

(75) Inventors: Tsun-Hung Huang, Taichung (TW); Jhon-Ci Liu, Taipei (TW)

(73) Assignees: Shenzhen Jiawei Photovoltaic Lighting Co., Ltd., Shenzhen (CN); Light-Core Limited, Shenzhen (CN)

( * ) Notice: Subject to any disclaimer, the term of this patent is extended or adjusted under 35 U.S.C. 154(b) by 40 days.

(21) Appl. No.: 12/976,380

(22) Filed: Dec. 22, 2010

(65) Prior Publication Data

US 2012/0147607 A1 Jun. 14, 2012

(51) Int. Cl.
*F21V 8/00* (2006.01)

(52) U.S. Cl. ..... 362/249.02; 362/800

(58) Field of Classification Search ..... 362/800, 362/249.02, 640, 646, 647, 612, 555, 545
See application file for complete search history.

(56) References Cited

U.S. PATENT DOCUMENTS

2009/0290345 A1* 11/2009 Shaner ..... 362/249.01
2010/0277917 A1* 11/2010 Shan ..... 362/249.02

* cited by examiner

*Primary Examiner* — Laura Tso

(57) ABSTRACT

A light module with a distinguishable characteristic and a detachable feature is adapted to an LED lamp. The light module includes an installing seat disposed on a seat body of the LED lamp, and an embedding seat designed in accordance with the installing seat. At least one mark area with a plurality of slots defined on the installing seat is able to combine with at least one buckling area with protrudent members on the embedding seat. By means of the cooperation of the mark area and the buckling area, users are able to judge the wattage of the light module, thereby preventing incompatibility between the LED member and light module due to different powers. Accordingly, a quick check on the polarity of the LED member before installation is brought about for increasing the using convenience.

2 Claims, 5 Drawing Sheets

LIGHT MODULE WITH A DISTINGUISHABLE CHARACTERISTIC AND A DETACHABLE FEATURE

BACKGROUND OF THE INVENTION

1. Field of the Invention

The present invention relates to a design of a light module, particularly to a light module with a distinguishable characteristic and a detachable feature.

2. Description of the Related Art

Referring to FIGS. 1 and 2, a conventional LED lamp 1 comprises a seat body 11 installed on a fixture 2, a light module 12 disposed in the seat body 11, and a heat dispersing device 13 (shown by a sketch) disposed on the seat body 11. Wherein, the light module 12 has a board 121 connected to the seat body 11 for providing electricity, and at least one LED member 122 connected to the board 121. In installation, an appropriate LED member 122 whose power is suitable for users' need is adopted. Then, the LED lamp 1 is able to be attached to the fixture 2 properly. Accordingly, when the power is on, the LED member 122 is powered by the electricity from the board 121 so as to light a working area.

However, in the practical operation, the installation of the conventional LED lamp 1 is inconvenient in view of the following shortcomings:

1. Aninseparable formation is commonly applied to the structure of the LED lamp 1. Herein, different LED lamps 1 actually have the same outward formation but dissimilar specifications and unrelated powers. That is because one light module 12 contained in the LED lamp 1 merely offers a single wattage, and the LED member 122 accordingly only provides its correlated luminosity. Therefore, in view of the inseparable formation, the need for different wattage and divergent luminosity thence requires distinct LED lamps 1 with various specifications, which results in a high manufacturing cost and low productivity.

2. In installation, users might accidentally connect the LED member 122 to the incorrect board 121 whose power is different from that of the LED member 122 since users could not figure out what wattage the board 121 is now providing. Herein, the connection of the incompatible LED member 122 and the board 121 may cause an overheating LED lamp 1. As a result, the LED lamp 1 is subject to damage.

3. Moreover, if users are unsatisfied with the luminosity provided by the LED member 122 after installation, or if any trifle part in the LED lamp 1 is broken, the entire LED lamp 1 has to be replaced since the structure of LED lamp 1 is indivisible. Obviously, such replacement of the LED lamp 1 is in fact unbenefited as only a small part needs the substitution but the whole set has to be detached from the fixture, which may be also considered as a wasteful work.

SUMMARY OF THE INVENTION

It is therefore the purpose of this invention to provide a light module with a distinguishable characteristic and a detachable feature for avoiding an incorrect connection between an LED member and a board. Preferably, the present invention also contributes to a quick check on the polarity of the LED member and results in the convenient utilization.

The light module with a distinguishable characteristic and a detachable feature is freely suited to an LED lamp. Wherein, the LED lamp includes a seat body for being attached to a fixture, and a heat dispersing device installed on the seat body. Characterized in that, the light module comprises a board that provides electricity, at least one LED member that mounts on the board, an installing seat positioned on the seat body, and an embedding seat connected to the board as well as designed in accordance with the installing seat. Further, at least one mark area with a plurality of slots is defined on the installing seat. At least one buckling area with protrudent members is formed on the embedding seat as well as designed in accordance with the mark area. The protrudent members on the buckling area are fixed in the slots when the embedding seat and the installing seat are engaged so as to recognize a wattage of the light module, thereby facilitating accuracy of compatible polarity of the LED member and check on the power of the same. Different dispositions of the mark area and the buckling area assist users to distinguish the wattage provided by the light module. Accordingly, an accidental and incorrect connection between the LED member and the board is avoided. Favorably, checking the polarity of the LED member and the board becomes easy. Thus, a rapid replacement and a swift installation preferably increase the using convenience of the present invention.

Preferably, the mark area of the installing seat is formed with the protrudent members, and the embedding area is formed with the slots; the slots and the protrudent members are able to mesh with each other; the protrudent member formed on the buckling area being inserted into the slot when the embedding seat and the installing seat are engaged so as to recognize a wattage of the light module, thereby facilitating accuracy of compatible polarity of the LED member and check on a power thereof.

DETAILED DESCRIPTION OF THE PREFERRED EMBODIMENTS

Figure 1:
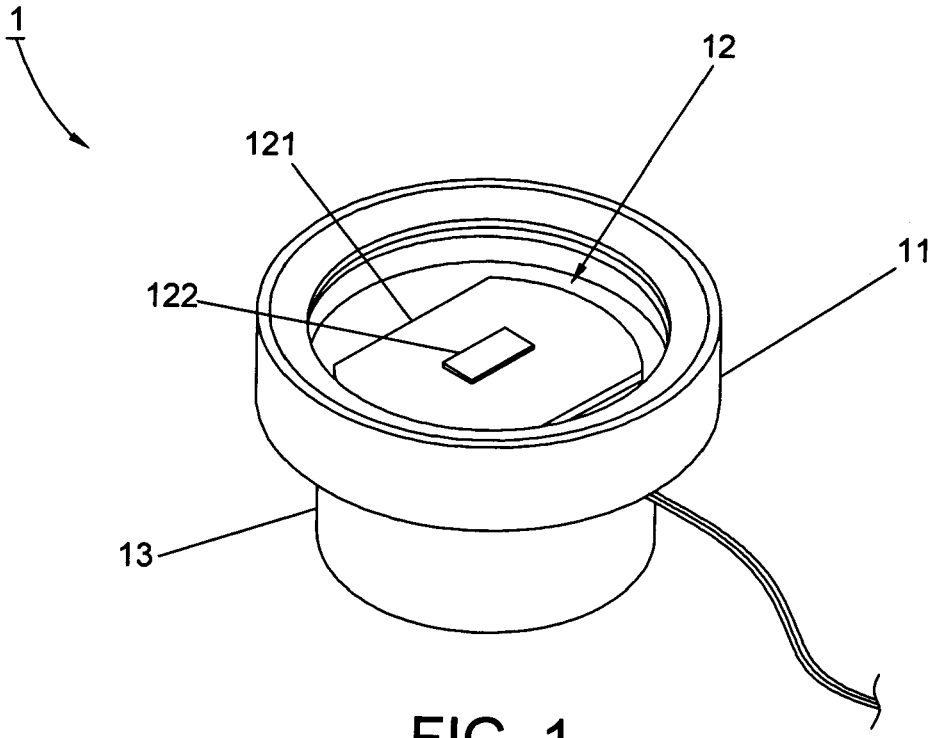
FIG. 1 (PRIOR ART)
FIGS. 1 and 2 are schematic views showing a conventional LED lamp.
Figure 2:
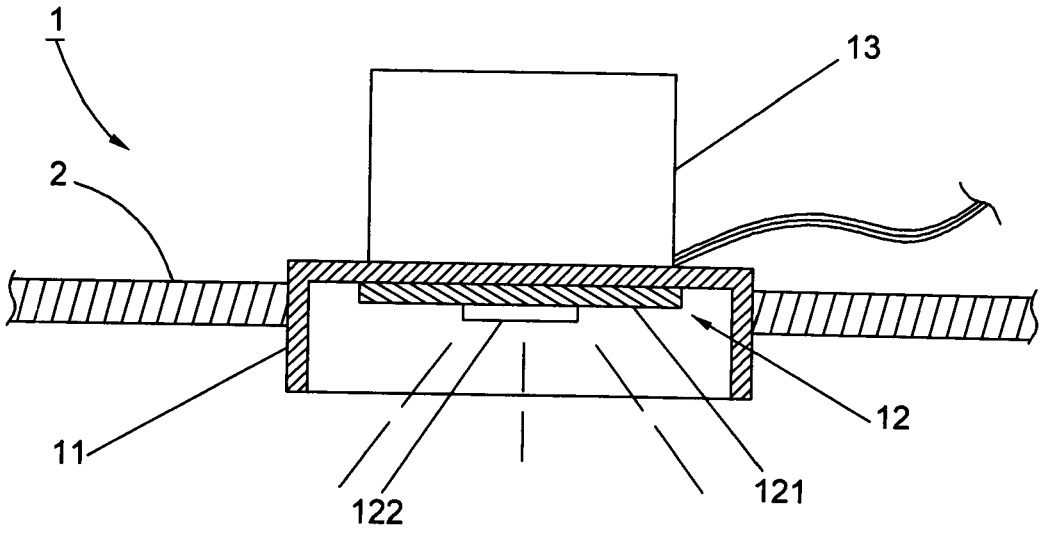
FIG. 2 (PRIOR ART)

Wherever possible, the same reference numbers are used in the drawings and the description to refer to the same or like parts.

Figure 3:
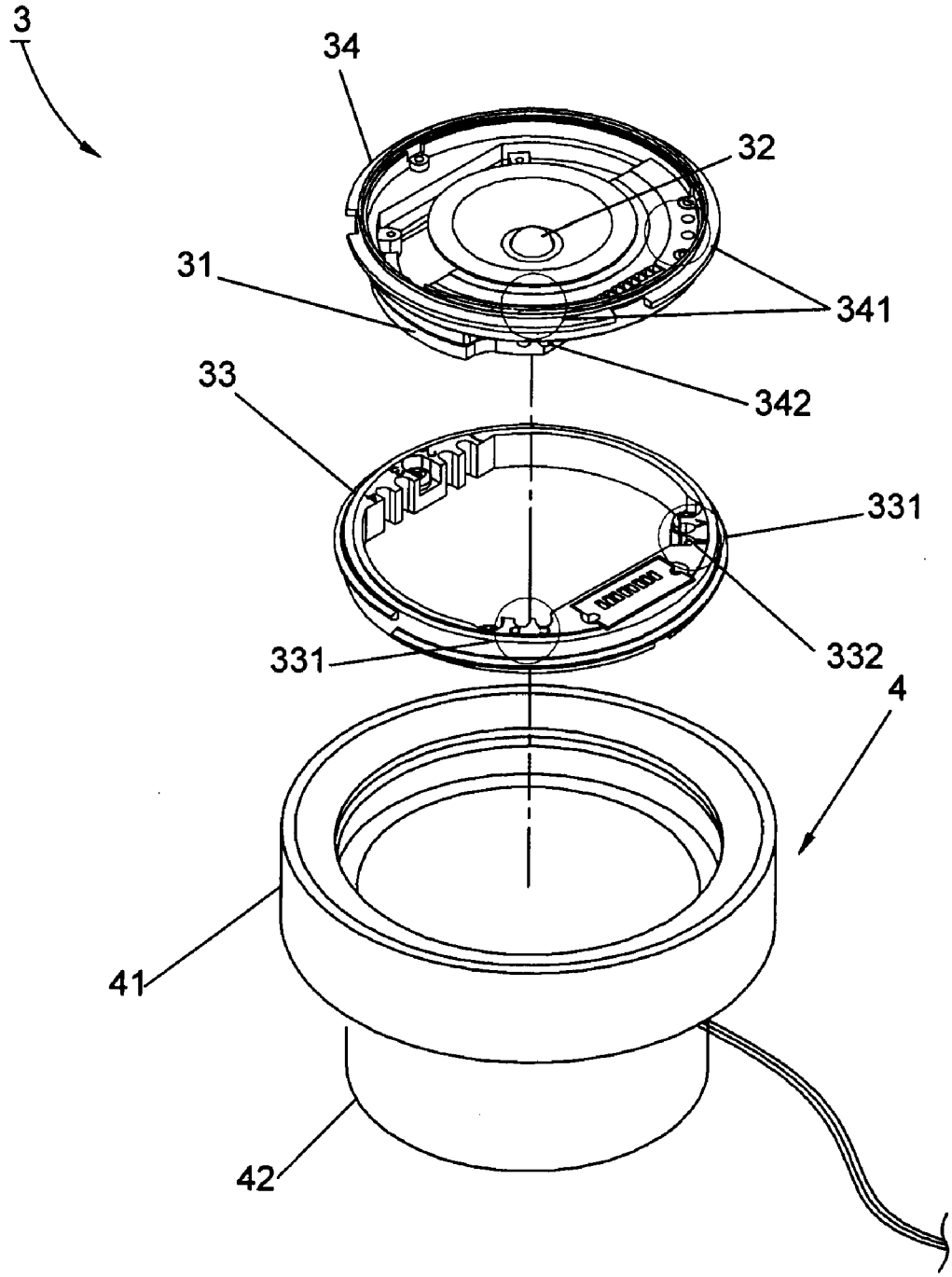
FIG. 3 is a schematic view showing a first preferred embodiment of the present invention.

Referring to FIG. 3, a first preferred embodiment of the present invention is shown. The light module 3 is suited to an existing LED lamp 4 which includes a seat body 41 for being attached to a fixture 5 (not shown), and a heat dispersing device 42 (shown by a sketch) disposed on the seat body 41.

The light module 3 has a board 31 that provides electricity, an LED member 32 connected to the board 31, an installing seat 33 disposed on the seat body, and an embedding seat 34 connected to the board 31 as well as designed in accordance with the installing seat 33. Preferably, the installing seat 33 and the embedding seat 33 could be made of iron or plastic. Moreover, at least one mark area 331 is defined on the installing seat 33. In this embodiment, there are two mark areas 331, each of which is respectively disposed on two sides of the installing seat 33 and is provided with a plurality of slots 332.

At least one buckling area 341 with a few protrudent members 342 is formed on the embedding seat 34 as well as designed in accordance with the mark area 331. In this embodiment, there are two buckling members 341, each of which is respectively disposed on two sides of the embedding seat 34. As it should be, the protrudent members 342 on the buckling area 341 are arranged with respect to the mark area 331.

Figure 4:
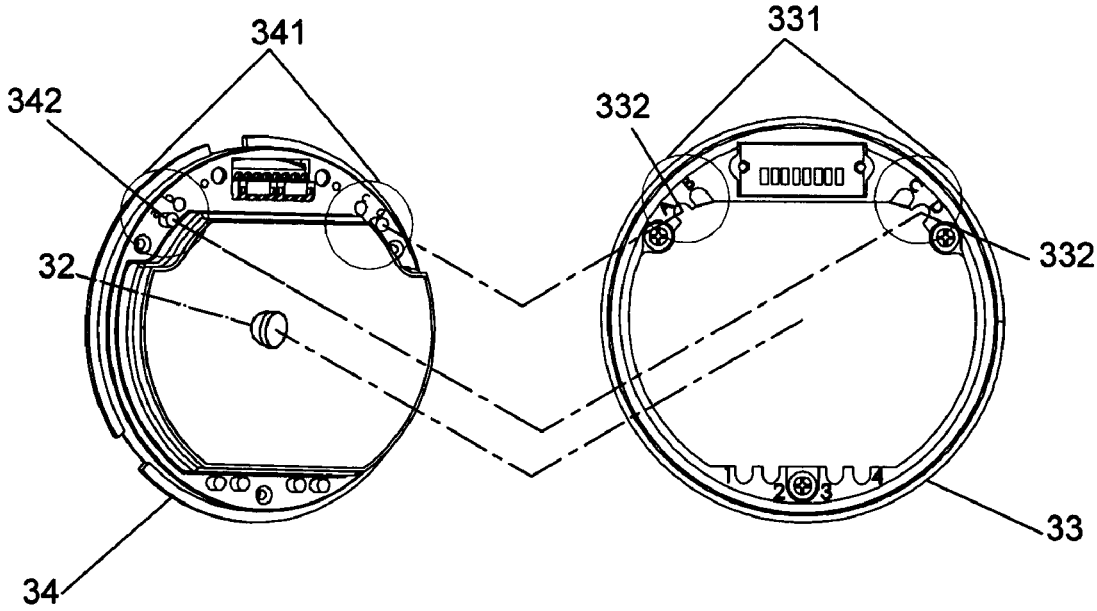
FIGS. 4 to 6 are schematic views showing some parts of the present invention.

In installation, referring to FIGS. 3 and 4, four slots 332 are formed on the mark area 331 of the installing seat 33 and respectively tagged with A, B, C, and D. Relatively, four protrudent members 342 are formed on the buckling area 341 and are respectively tagged with a, b, c, and d. In this embodiment, only the slots A and D are passable. Thus, in combining the installing seat 33 and the embedding seat 34, the correspondent protrudent members a and d are able to be fitted in the slots A and D. As to the remained protrudent members b and c, they are eliminated as shown in FIG. 4. Accordingly, users are able to distinguish the wattage of the light module 3 according to the engaging sate of the slots and the protrudent members, so that an appropriate LED member 32 could be compatible thereto. Namely, the passable slots 332 that are tagged with A and D and the correspondent insertion of the protrudent members 342 that are tagged with a and d cooperatively allow a 10-watt-LED member 32 to be installed thereto. Differently and referring to FIG. 5, when the slots 332 that are tagged with A, B, and D are passable for the protrudent members 342 that are tagged with a, b, and d, a 10-watt-LED member 32 and a 20-watt-LED member 32 could be respectively installed thereto. Similarly and referring to FIG. 6, when the slots 332 that are tagged with A, B, C, and D are passable for the protrudent members 342 that are tagged with a, b, c, and d, a 10-watt-LED member 32, a 20-watt-LED member 32, and a 30-watt-LED member 32 could be respectively installed thereto. Obviously, the LED member 32 that emits higher illumination needs more slots 332 to cooperate with more protrudent members 342. Accordingly, the light module 3 could be solely sold without the LED lamp 4, or the light module 3 could be sold for cooperating with the existing LED lamp 4.

Figure 5:
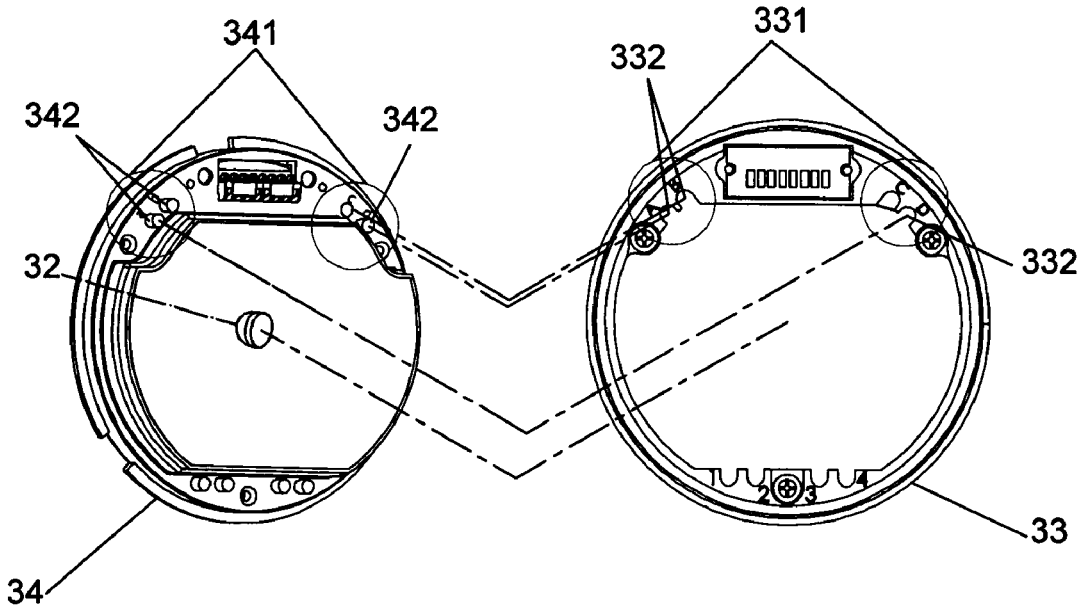
Figure 6:
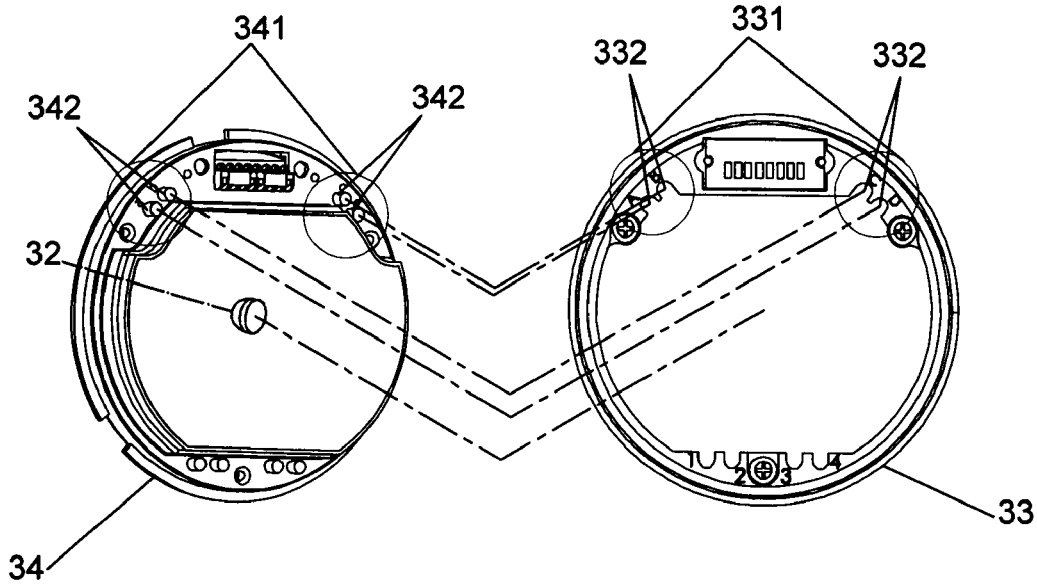
Figure 7:
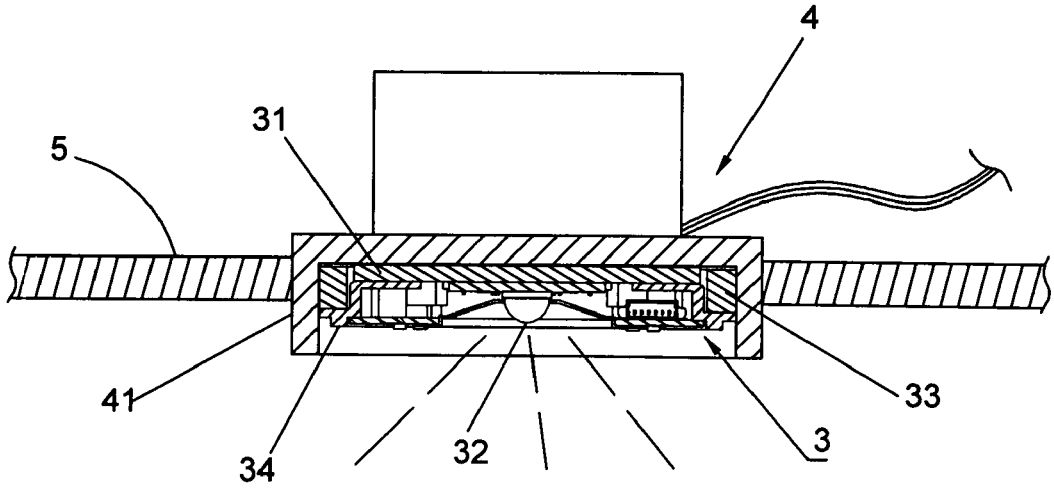
FIG. 7 is a schematic view showing the present invention in installing.

Referring to FIGS. 5 and 7, when the light module 3 is applied to the existing LED lamp 4, users may be unsatisfied with the brightness provided by the conventional LED lamp 4. In this circumstance, the 20-watt LED member is probably needed for substitution. Herein, only the light module 3 needs the substitution; users do not have to change the whole set of the LED lamp 4. Additionally, the substitution is in fact easy while simply installing a new light module 3 to the seat body 41. Thereafter, the embedding seat 34 and the installing seat 33 that both are connected to the board 31 are firmly combined. Succeedingly, the installing seat 33, which defines the mark area 331 with the slots 332 tagged with A, B, and D, is directly engaged to the seat body 41. As a result, the correspondent protrudent members 342, which are disposed on the buckling area 341 and tagged with a, b, and d, further insert to the slots 332. Afterward, the LED member 32 compatible with the light module 3 is connected to the board 31 for achieving an easy and swift replacement. Evidently, by the cooperation of the mark area 331 and the buckling area 341, the compatibility between the LED member 32 and the light module 3 could be easily distinguished via the divergent dispositions of the slots 332 and the protrudent members 342. Thus, accidental connection between the LED member 32 and the light module 3 could be avoided, and the checking on the polarity of the LED member 32 is also quick. Thereby, an express installation is achieved, and the using convenience is also obtained.

Figure 8:
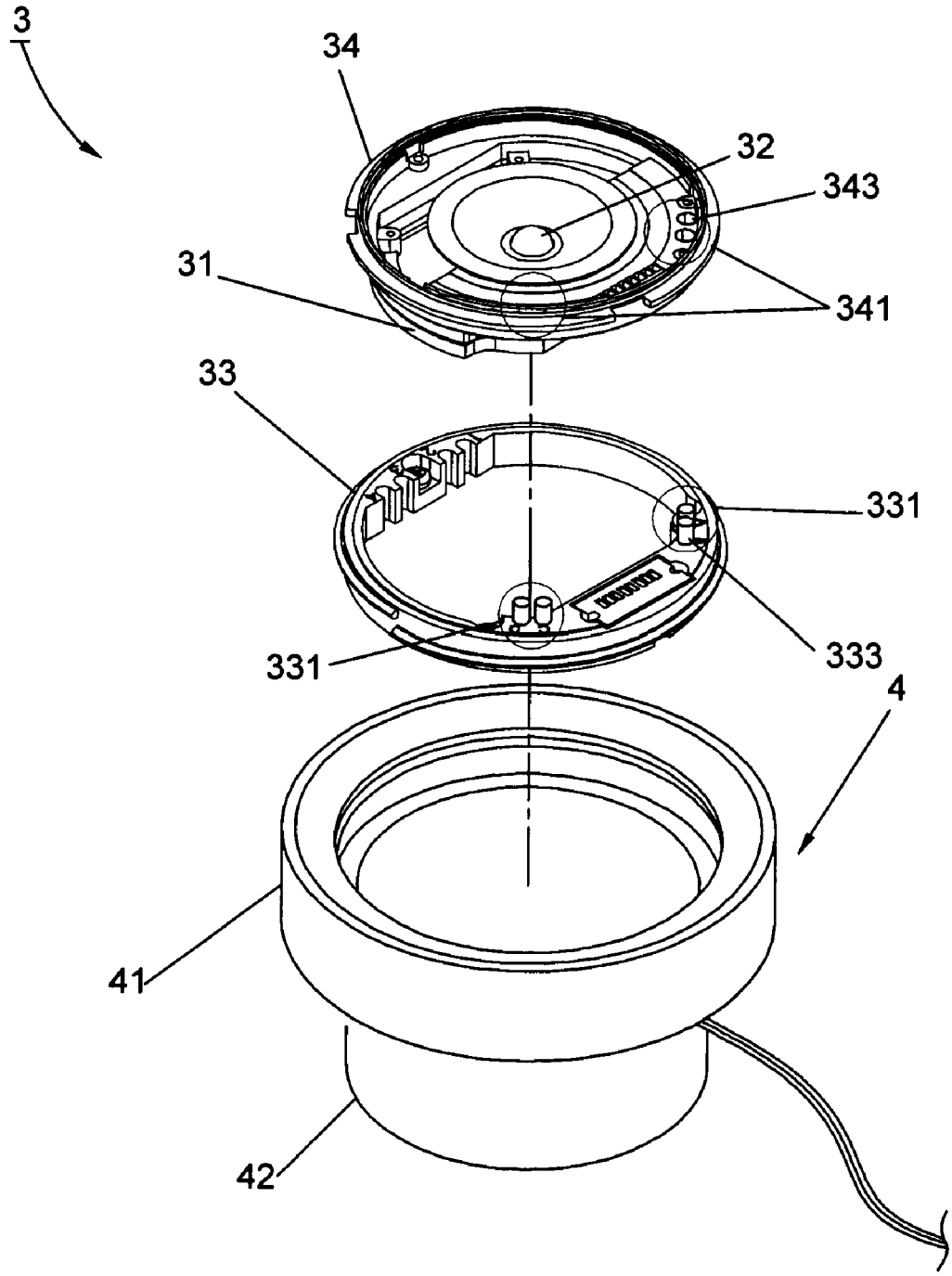
FIG. 8 is a schematic view showing a second preferred embodiment of the present invention.

Referring to FIG. 8, a second preferred embodiment of the present invention is shown. The light module 3 still comprises the similar elements as those in the first preferred embodiment like the board 31, the LED member 32, the installing seat 33, and the embedding seat 34. Differently, in this embodiment, the mark area 331 of the installing seat is formed with at least one protrudent member 333, and the buckling area 341 on the embedding seat 34 is formed with a plurality of slots 343. Herein, the slots 343 and the protrudent members 333 are able to mesh with each other. Thereby, the protrudent members 333 formed on the buckling area 341 could be fitted in the slots 343 when the embedding seat 34 and the installing seat 33 are engaged so as to recognize the wattage of the light module 3. Thereby, the light module 3 and the LED member 32 are accurately compatible with each other, and the polarity of the LED member 32 could be checked timely.

Evidently, the present invention has following advantages:

1. In order to be compatible with different LED members 32 that provide various power or luminosity, the light module 3 of the present invention is able to support a variety of specifications of the LED member 32. Namely, a single mold is sufficient to manufacture such light module 3, which reduces the manufacturing cost and increases the productivity.

2. In the safety point of view, the mark area 331 on the installing seat 33 could be correspondingly combined with the buckling area 341 on the embedding seat 34. By means of the divergent disposing manners between the mark area 331 and the correspondent buckling area 341, users are able to judge what wattage the light module 3 offers now. Thus, the incorrect installation and the wrong connection could be prevented, the checking on the polarity of the LED member 32 could be quickly executed, and the LED lamp 4 does not become overheating and damage.

3. In addition, if users are unsatisfied with the luminance emitted from the LED member 32, or some part in the light module 3 is broken, they do not have to change the entire LED lamp 4. Users can directly change the LED member 32 with a new one or the one with a greater power; users can also directly replace the broken part with a new part. Therefore, the using life of the LED lamp 4 is extended, which largely decreases the maintaining cost and contributes to an economical effect.

To sum up, the present invention particularly utilizes the installing seat of the light module to engage with the embedding seat of the same to bring about a distinguishable feature by means of the mark area and the buckling area. Thus, the light module could be freely compatible with the LED member even if the LED member has a variety of power specifications, and the installation of the light module could be prevented from the inaccuracy. Preferably, the present invention contributes to a quick checking on the polarity, a prompt replacement, and a convenient operation.

While we have shown and described the embodiment in accordance with the present invention, it should be clear to those skilled in the art that further embodiments may be made without departing from the scope of the present invention.

We claim:

1. A light module with a distinguishable characteristic and a detachable feature being installed on an LED lamp that includes a seat body for being attached to a fixture and for being fitted with said light module, and a heat dispersing device disposed on said seat body; said light module having a board that provides electricity and an LED member connected to said board;

characterized in that, said light module further includes an installing seat disposed on said seat body, and an embedding seat connected to said board as well as designed in accordance with said installing seat; wherein, at least one mark area with a plurality of slots is defined on said installing seat; at least one buckling area with at least one protrudent member being formed on said embedding seat as well as designed in accordance with said mark area; said protrudent member formed on said buckling area being inserted into said slot when said embedding seat and said installing seat are engaged so as to recognize a wattage of said light module, thereby facilitating accuracy of compatible polarity of said LED member and check on the power of the same; recognizing said wattage presented on said light module allowing users to check if said polarity and said power of said LED member are suitable to said correlated light module within a short time.

2. The light module as claimed in claim 1, wherein, said mark area of said installing seat is formed with said protrudent members, and said embedding area is formed with said slots; said slots and said protrudent members are able to mesh with each other; said protrudent member formed on said buckling area being inserted into said slot when said embedding seat and said installing seat are engaged so as to recognize a wattage of said light module, thereby facilitating accuracy of compatible polarity of said LED member and check on a power thereof.

* * * * *